US008528241B2

(12) United States Patent
Pichler

(10) Patent No.: US 8,528,241 B2
(45) Date of Patent: Sep. 10, 2013

(54) TRIGGER MECHANISM FOR A FIREARM

(75) Inventor: Harald Pichler, Gaflenz (AT)

(73) Assignee: Steyr Mannlicher Holding GmbH, Kleinraming (AT)

( * ) Notice: Subject to any disclaimer, the term of this patent is extended or adjusted under 35 U.S.C. 154(b) by 34 days.

(21) Appl. No.: 13/378,890

(22) PCT Filed: May 6, 2010

(86) PCT No.: PCT/AT2010/000150

§ 371 (c)(1),
(2), (4) Date: Dec. 16, 2011

(87) PCT Pub. No.: WO2011/000003

PCT Pub. Date: Jan. 6, 2011

(65) Prior Publication Data

US 2012/0096753 A1 Apr. 26, 2012

(30) Foreign Application Priority Data

Jun. 30, 2009 (AT) ..... A 1020/2009

(51) Int. Cl.
*F41A 17/64* (2006.01)
*F41A 19/00* (2006.01)

(52) U.S. Cl.
USPC ..... 42/69.01; 42/69.02

(58) Field of Classification Search
USPC ..... 42/69.01–69.03; 89/137, 142, 149, 89/150
See application file for complete search history.

(56) References Cited

U.S. PATENT DOCUMENTS

| | | | | |
|---|---|---|---|---|
| 2,224,758 | A * | 12/1940 | Brewer | 89/139 |
| 4,908,970 | A * | 3/1990 | Bell | 42/69.02 |
| 5,784,818 | A * | 7/1998 | Otteson | 42/70.04 |
| 6,681,511 | B1 * | 1/2004 | Huber | 42/69.01 |
| 2011/0094139 | A1 * | 4/2011 | Atzl | 42/69.01 |
| 2012/0131832 | A1 * | 5/2012 | Arduini | 42/69.01 |

FOREIGN PATENT DOCUMENTS

| | | | |
|---|---|---|---|
| AT | 409548 | B | 9/2002 |
| DE | 4402951 | A1 | 8/1995 |
| EP | 0312971 | A1 | 10/1988 |
| WO | WO9963294 | | 12/1999 |

OTHER PUBLICATIONS

International Search Report for PCT/AT2010/000150 dated Jul. 23, 2010.
ISA Written Opinion for PCT/AT2010/000150 dated Apr. 30, 2011.
Austrian Official Action dated Mar. 17, 2010.
International Preliminary Report on Patentability dated Jan. 17, 2012.

* cited by examiner

*Primary Examiner* — Bret Hayes
*Assistant Examiner* — Joshua Freeman
(74) *Attorney, Agent, or Firm* — Hoffmann & Baron, LLP

(57) ABSTRACT

The invention relates to a trigger mechanism for a firearm, comprising a spring-loaded firing pin which, when in the cocked position, engages on a catch. The catch can be released at a right angle to the direction of the firing pin to fire and can be displaced between the cocked position and a safety position uncocking the firing pin spring along the direction of the firing pin to lock the firearm. The catch slides on an intermediate member when displaced, said member being movable in the direction of release of the catch and engaging on a click-stop edge of a trigger, which click-stop edge can be disengaged to fire.

18 Claims, 3 Drawing Sheets

TRIGGER MECHANISM FOR A FIREARM

CROSS-REFERENCE TO RELATED APPLICATIONS

This application is a National Phase application of International Application No. PCT/AT2010/000150 filed May 6, 2010 which claims priority to Austrian Patent Application No. A 1020/2009 filed Jun. 30, 2009.

BACKGROUND

The present invention relates to a trigger device for a firearm with a spring-loaded firing pin that engages with a catch in the cocked position, the catch being releasable transversely to the direction of the firing pin in order to fire a shot, and displaceable along the direction of the firing pin, for safety purposes, between the cocked position and a safety position relieving the tension of the firing pin spring.

Movable catches for cocking and uncocking the firing pin spring are used for temporarily securing an already loaded weapon, e.g., for transport or while hunting. For this purpose, designs are known (e.g. AT 409 548 B) in which the catch is situated together with its initiator on a carriage that is movable in the housing and cooperates with the trigger. This type of carriage structure requires a number of moving parts, which has the disadvantage of an increased susceptibility to malfunctions and an increased space requirement. There are also known designs on the market in which the catch moves relative to its initiator when displaced, which impairs the precision of the shot trigger point and consequently also bears the risk of an unintended shot being fired if there is too little engagement overlap.

SUMMARY

The invention has the objective of overcoming the disadvantages of the prior art and creating a trigger device for a firearm that is simple and not susceptible to malfunction on the one hand and, on the other, allows an exact definition of when the shot is triggered.

This objective is achieved with a trigger device of the type mentioned above that is distinguished according to the invention in that the catch slides during displacement on an intermediate member that is movable in the direction of release of the catch, and engages with a click-stop edge of a trigger, which edge can be disengaged to fire a shot.

The triggering engagement, which is decisive for the release of the catch, is shifted in this manner from the catch to an intermediate member guided in the housing. This allows an exactly definable engagement overlap, independent of the displacement of the catch, for adjusting the trigger-press point.

The trigger is preferably seated in the housing of the firearm and bears on a shoulder the click-stop edge for the intermediate member, whereby the triggering point for firing a shot can be defined especially exactly.

It is particularly favorable if the intermediate member is a catch rod guided linearly in the housing of the firearm, which yields a simple structure.

According to another preferred embodiment of the invention, the catch slides on the intermediate member via an intercalated roller. This reduces the friction of the catch in its movement between the cocked position and the safety position, so that the cocked position can be reached with less exertion of force than with known solutions.

The roller is preferably located at the upper end of the catch rod, whereby the catch is simplified and reduced in weight. It is particularly favorable if the roller is seated with a ball bearing, in order to reduce friction even further.

According to another advantageous embodiment of the invention, it is provided that the extent of the engagement overlap of the intermediate member with the click-stop edge of the trigger is adjustable by means of an adjustment screw. Thereby the trigger point of the weapon can be adjusted, independently of the positions of the catch.

It is particularly favorable if the catch can be moved between the cocked position and the safety position by a cocking slide that acts on the actuation element via a linkage, as is known from prior art. Alternatively, the catch could also be actuated by a cocking wheel via a suitable linkage.

The trigger device according to the invention is suitable for any type of firearm with a firing pin and a catch that can be moved for safety purposes. Preferably, however, the firearm is a semiautomatic weapon with a rotary piston action and in particular, the firing pin engages with the catch by means of an attached firing pin tab; for these types of weapon, the trigger device of the invention leads to particularly low overall height and easy integration.

BRIEF DESCRIPTION OF THE DRAWINGS

The invention will be explained in detail below with reference to an embodiment example illustrated in the attached drawings. In the drawings.

DETAILED DESCRIPTION

Figure 1:
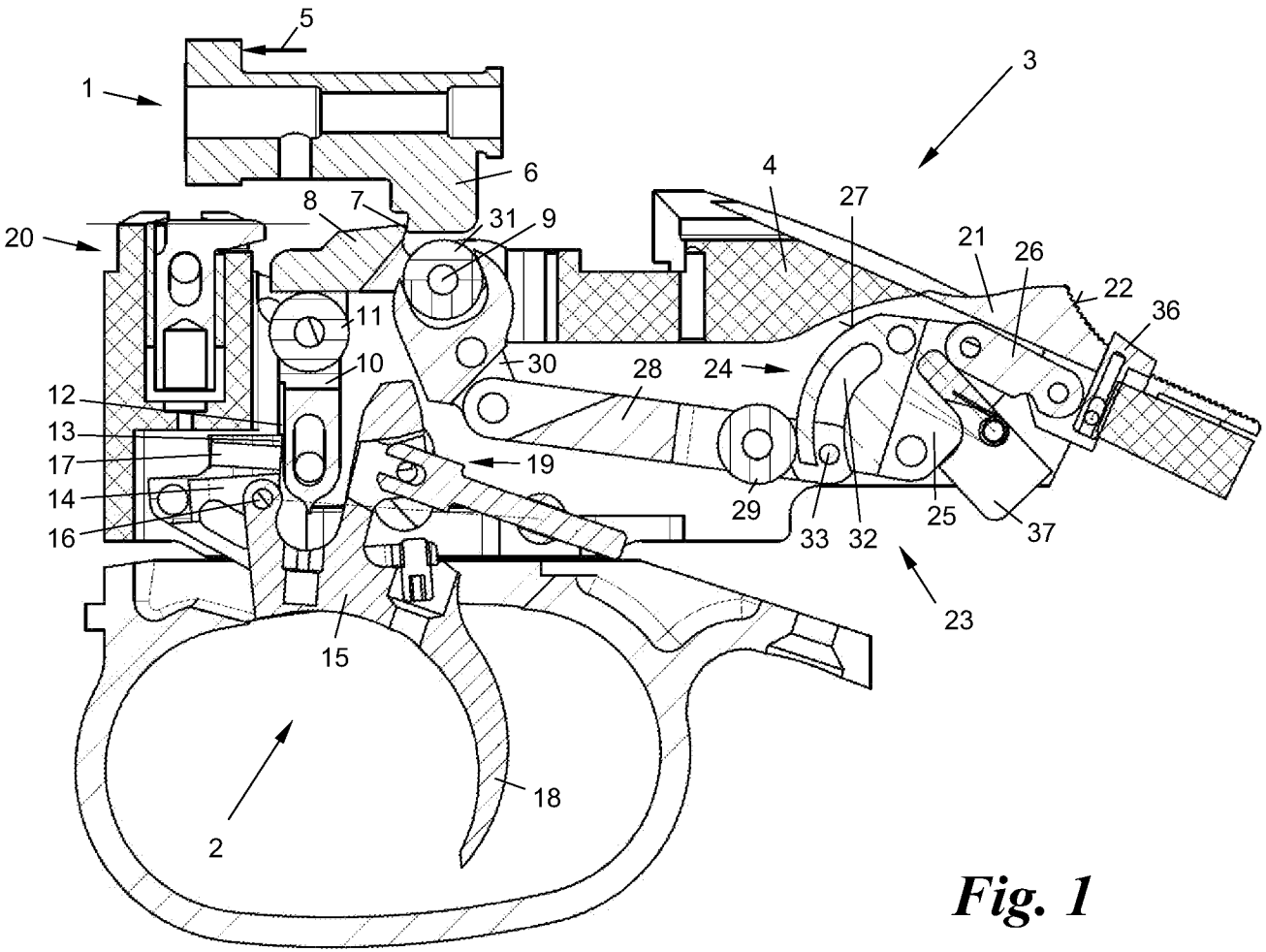
FIGS. 1-3 show the trigger device of the invention in cross section in the safety position (FIG. 1), the cocked position (FIG. 2) and the position after firing (FIG. 3).
Figure 2:
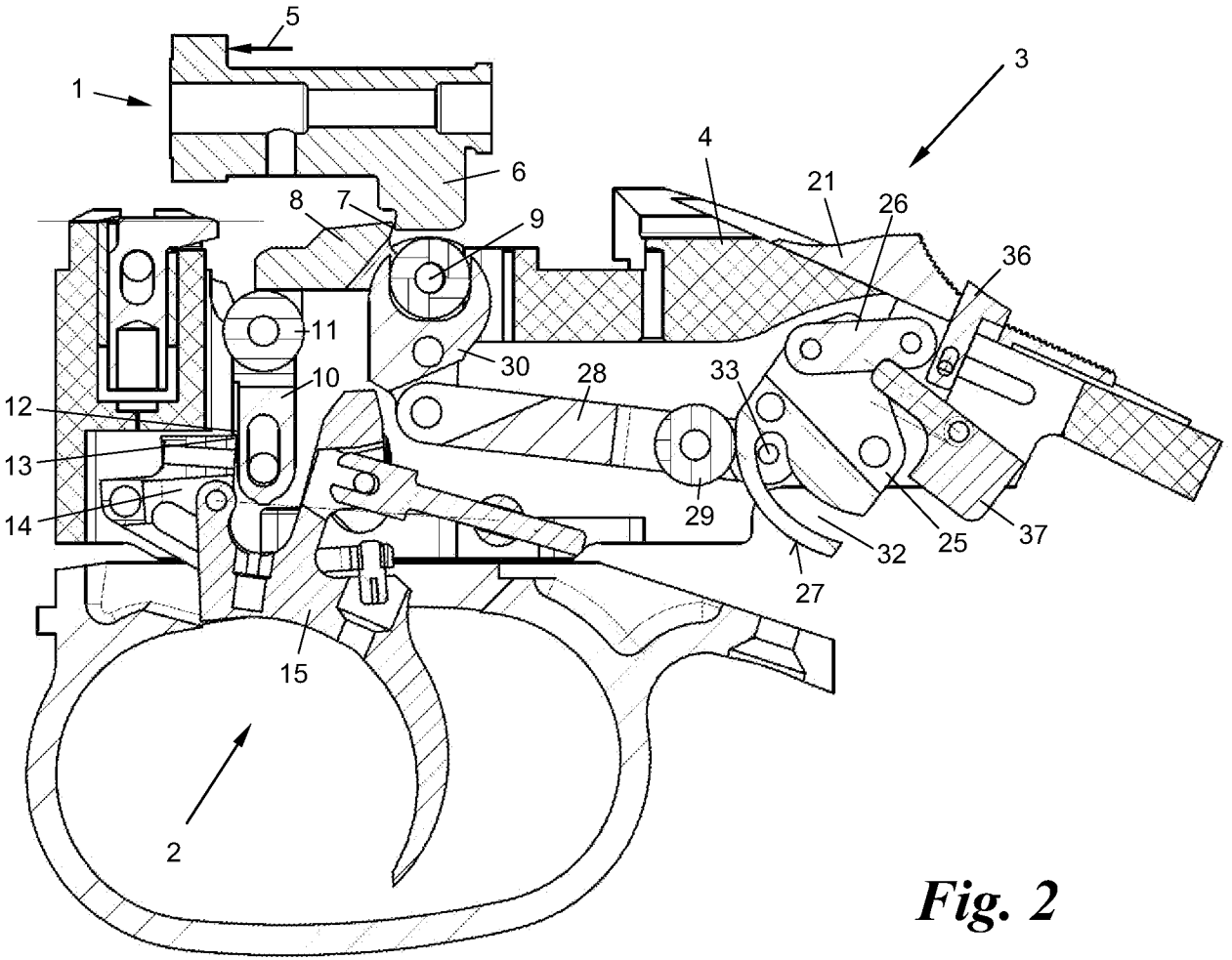
Figure 3:
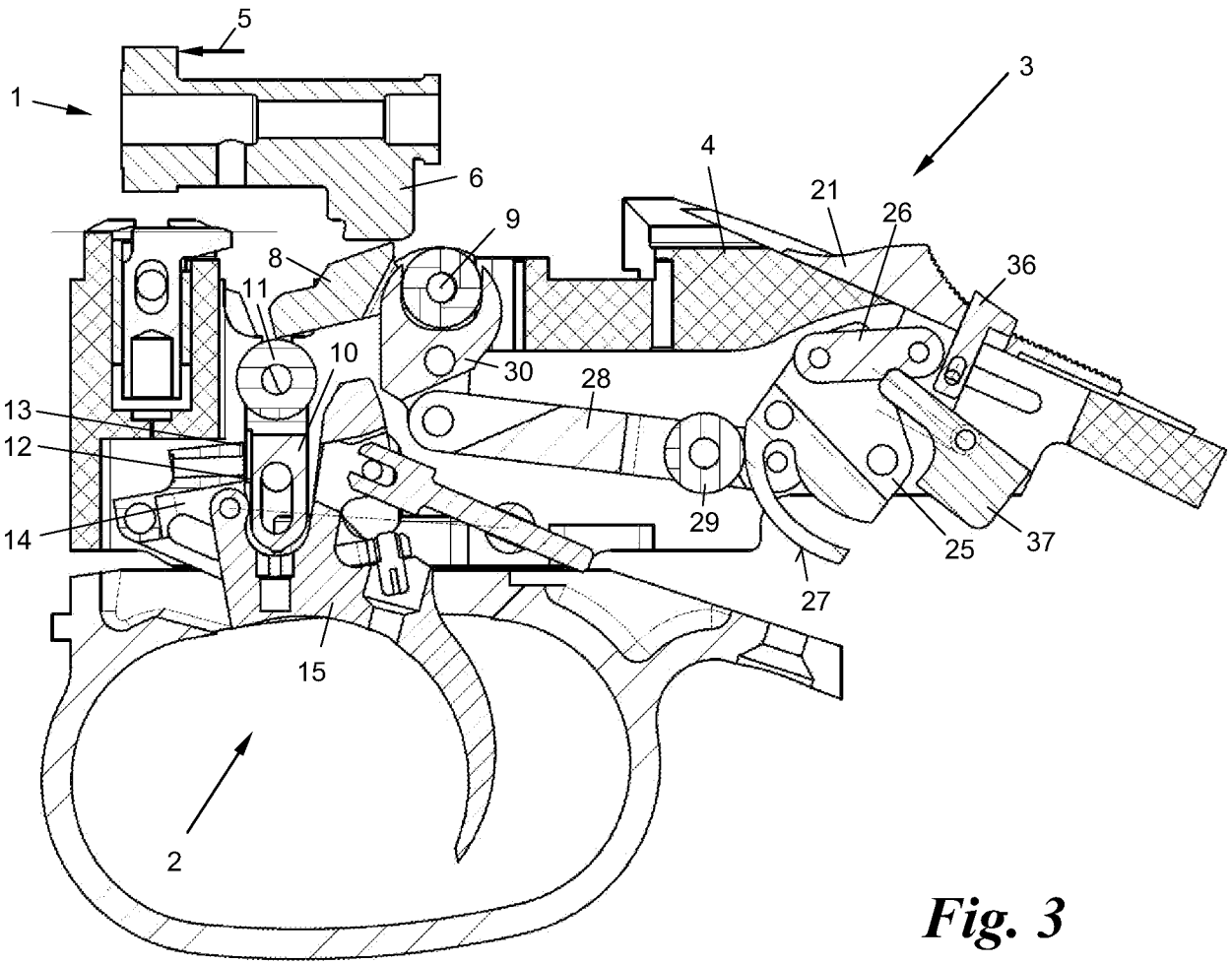

FIGS. 1-3 show the rear part of a firing pin 1, a trigger device 2, a cocking and uncocking mechanism 3 and (in part) a housing 4 of a firearm (not shown in further detail). The firing pin 1 acts on a cartridge in the chamber of a rifle barrel and is guided for this purpose in a rotary piston, which parts are known to those in the art and are therefore not shown in detail here.

The firing pin 1 is subjected to a force to the left in the drawing by a firing pin spring 5 (indicated schematically) and is engaged with a firing pin tab 6 at point 7 on a catch 8. The catch 8 is seated movably, in both the longitudinal and the transverse directions of the firing pin, by a bearing journal 9 in elongated holes of the housing 4. Thus the catch 8 can first be released from the firing pin 1 by means of the trigger device 2 to fire a shot, so that the pin moves to the left by the force of the firing pin spring 5 to collide with the cartridge (see position after firing in FIG. 3); second, the catch 8 can thus be moved or displaced in the longitudinal direction between two positions, specifically:

an unsecured or cocked position (FIG. 2), in which the catch holds the firing pin 1 cocked against the force of the firing pin spring 5 (with a rotary piston action, the firing pin 1 can be brought into this position by an ordinary chamber stem during the loading or repeating process); and an uncocked safety (FIG. 1) in which the catch 8 is displaced to the left, in order to relieve the tension of the firing pin spring 5 (a slight residual tension can be left in the firing pin spring 5 in order to move the front part of the firing pin 1—not shown here—slightly away from the bottom of the cartridge).

In this respect, the catch 8 is a part of the trigger device 2 as well as the cocking and uncocking mechanism 3.

To absorb the above-mentioned displacement motion of the catch 8, the trigger mechanism 2 comprises an intermediate element in the form of a catch rod 10 that is linearly guided in the housing 4 approximately vertically and supports a ball bearing-seated roller 11 at its upper end, on which the catch 8 can slide back and forth. The catch rod 10 in turn is engaged at a shoulder 12 on a click-stop edge 13 formed on a shoulder 14 of the trigger 15. The trigger 15 is pivotably seated at 16 on the housing 4 and when actuated moves the click-stop edge 13 away from the catch rod 10, so that the latter is moved downward (FIG. 3) and releases the catch 8 from the firing pin 1, whereby the shot is fired. The extent of the engagement overlap between the shoulder 12 of the catch rod 10 and the click-stop edge 13 of the trigger 15 can be adjusted by means of an adjusting screw 17.

The trigger 15 with its click-stop edge 13 can be integrally formed or, as shown, as two parts adjustable relative to one another, such as a first part comprising a trigger blade 18 and a second part comprising the shoulder 14 with the click-stop edge 13. The trigger 15 can further be equipped with a drop guard 19 and a bolt catch 20 for triggering a rotary piston action, as known to those in the art.

The cocking and uncocking mechanism 3 comprises an actuator element 21 in the form of a cocking slide 21 seated slidably on the outside of the housing 4 with a thumb-press surface 22, which acts via a linkage 23 on the catch 8 in order to move it back and forth in the longitudinal direction of the firing pin between its two positions (FIGS. 1 and 2). The linkage 23 contains a motion link 24, via which the force/distance transmission ratio between the actuator element 21 and catch 8 can be adjusted.

The motion link 24 comprises a pivoting crank 25 that can be pivoted by the cocking slide 21 via a connecting rod 26 and bears a control cam 27 on its outer periphery. A sensing linkage 28 with a ball bearing-seated cam follower 29 rolls over the control cam 27 and translates the shape of the control cam 27 into a movement of the catch 8 via a housing-seated two-armed lever 30 that engages with a pin 31 of the catch 8.

The pivoting crank 25 is also equipped with an auxiliary linkage guide 32 in the form of a groove guide that is located behind the control cam 27 and with which the sensing linkage 28 engages by means of a retaining pin 33 projecting past the cam follower 29. Thereby a forced contact of the cam follower 29 on the control cam 27 is assured in every operating state.

When the cocking slide 21 in FIGS. 1 and 2 is moved from right to left, the pivoting crank 25 swings downward, the sensing link 28 slides to the left on the control cam 27, and the catch 8 is moved to the right by the lever 29 against the force of the firing pin spring 5. With the aid of a pushbutton 36 on the cocking slide 21, a self-locking latch 37 for locking the connecting rod 26 in the cocked position C can again be disengaged.

All rotary or pivot bearings in the mechanism can preferably be implemented by means of rolling contact bearings in order to reduce friction.

The invention is accordingly not limited to the illustrated embodiments, but instead comprises all variants and modifications that fall within the scope of the appended claims.

The invention claimed is:

1. A trigger device seated within a housing of a firearm with a spring-loaded firing pin that engages with a catch in the cocked position, the catch being releasable transversely to the direction of the firing pin in order to fire a shot, and displaceable along the direction of the firing pin, for safety purposes, between a cocked position and a safety position relieving the tension of the firing pin spring, wherein the catch slides during displacement along an upper end of an intermediate member, the movement of the catch from the safety position to the cocked position being independent from a trigger position, and a side wall of the intermediate member having a shoulder which engages with a click-stop edge of a trigger, which click-stop edge can be disengaged from the shoulder of the intermediate member to fire a shot, and wherein the intermediate member comprises a catch rod guided linearly in the housing of the firearm.

2. The trigger device according to claim 1, wherein the click-stop edge pivots away from the shoulder of the intermediate member when the trigger is pulled.

3. The trigger device according to claim 1, wherein the catch slides via a roller mounted to the upper end of on the intermediate member to reduce friction on the catch when moved from the safety position to the cocked position.

4. The trigger device according to claim 1, wherein a roller is seated on the upper end of the catch rod.

5. The trigger device according to claim 4, wherein the roller is seated with ball bearings.

6. The trigger device according to claim 1, wherein the extent of an engagement overlap of the intermediate member shoulder with the click-stop edge of the trigger is adjustable by means of an adjustment screw.

7. The trigger device according to claim 1, wherein the catch can be moved between the cocked position and the safety position by a cocking slide that acts on the catch via a linkage.

8. The trigger device according to claim 1, wherein the firearm is a semiautomatic weapon with a rotary piston action.

9. The trigger device according to claim 1, wherein the firing pin engages with the catch by means of an attached firing pin tab.

10. A trigger device for a firearm with a spring-loaded firing pin comprising:

a housing, trigger, an intermediate member and a catch, the firing pin being engageable with the catch in the cocked position, the catch being releasable transversely to the direction of the firing pin in order to fire a shot, and displaceable along the direction of the firing pin, for safety purposes, between the cocked position and a safety position relieving the tension of the firing pin spring, wherein the catch slides during displacement along an upper end of the intermediate member, the movement of the catch from the safety position to the cocked position being independent from a trigger position, and wherein the intermediate member includes a shoulder provided on a side wall thereof which engages with a click-stop edge of a trigger, which edge can be disengaged to fire a shot, and further wherein the intermediate member comprises a catch rod linearly guidable in the housing of the firearm.

11. The trigger device according to claim 10, wherein the catch slides via an intercalated roller on the intermediate member.

12. The trigger device according to claim 11, wherein the roller is seated on the upper end of the catch rod.

13. The trigger device according to claim 12, wherein the roller is seated with ball bearings.

14. The trigger device according to claim 10, wherein an engagement overlap of the intermediate member with the click-stop edge of the trigger is adjustable by means of an adjustment screw.

15. The trigger device according to claim 10, wherein the catch can be moved between the cocked position and the safety position by a cocking slide that acts on the catch via a linkage.

16. The trigger device according to claim 10, wherein the firearm is a semiautomatic weapon with a rotary piston action.

17. The trigger device according to claim 10, wherein the firing pin engages with the catch by means of an attached firing pin tab.

18. The trigger device according to claim 10, wherein the trigger is seated in the housing of the firearm and further wherein the click-stop edge pivots away from the shoulder of the intermediate member when the trigger is pulled.

* * * * *